US010161081B2

(12) United States Patent
Blondel et al.

(10) Patent No.: US 10,161,081 B2
(45) Date of Patent: Dec. 25, 2018

(54) SIZING COMPOSITION AND PROCESS FOR TEXTILE MATERIALS

(71) Applicant: S.P.C.M. SA, Andrezieux Boutheon (FR)

(72) Inventors: Frédéric Blondel, Lezigneux (FR); David Sanchez, Aurec-sur-loire (FR)

(73) Assignee: S.P.C.M SA, Andrezieux Boutheon (FR)

( * ) Notice: Subject to any disclaimer, the term of this patent is extended or adjusted under 35 U.S.C. 154(b) by 11 days.

(21) Appl. No.: 14/443,496

(22) PCT Filed: Nov. 15, 2013

(86) PCT No.: PCT/EP2013/073921
§ 371 (c)(1),
(2) Date: May 18, 2015

(87) PCT Pub. No.: WO2014/079776
PCT Pub. Date: May 30, 2014

(65) Prior Publication Data

US 2015/0308040 A1 Oct. 29, 2015

(30) Foreign Application Priority Data

Nov. 20, 2012 (FR) ..... 12 61042

(51) Int. Cl.

| | |
|---|---|
| ***D06M 15/27*** | (2006.01) |
| ***D06L 1/14*** | (2006.01) |
| ***D06M 15/285*** | (2006.01) |
| ***D06M 15/29*** | (2006.01) |
| ***D06M 15/347*** | (2006.01) |
| ***D06B 3/00*** | (2006.01) |
| ***D06M 15/263*** | (2006.01) |

(52) U.S. Cl.
CPC ..... *D06M 15/27* (2013.01); *D06B 3/00* (2013.01); *D06L 1/14* (2013.01); *D06M 15/263* (2013.01); *D06M 15/285* (2013.01); *D06M 15/29* (2013.01); *D06M 15/347* (2013.01); *D06M 2200/40* (2013.01)

(58) Field of Classification Search
None
See application file for complete search history.

(56) References Cited

U.S. PATENT DOCUMENTS

| | | | | |
|---|---|---|---|---|
| 4,192,649 | A * | 3/1980 | Kato | C02F 1/5236 210/729 |
| 5,726,267 | A * | 3/1998 | Howland | C02F 5/12 524/413 |
| 5,965,659 | A * | 10/1999 | Kubo | C08L 51/003 524/504 |
| 2004/0166313 | A1 | 8/2004 | Key et al. | |

FOREIGN PATENT DOCUMENTS

| | | |
|---|---|---|
| EP | 0 945 543 A2 | 9/1999 |
| FR | 2 842 814 A1 | 1/2004 |
| FR | 2 879 630 A1 | 6/2006 |

OTHER PUBLICATIONS

International Search Report for International Application PCT/EP13/73921, dated Nov. 28, 2013.

* cited by examiner

*Primary Examiner* — Robert S Walters, Jr.
(74) *Attorney, Agent, or Firm* — Heslin Rothenberg Farley & Mesiti P.C.

(57) ABSTRACT

Use for sizing textile materials with an aqueous sizing composition including at least one co-polymer obtained by the polymerization of at least one non-ionic monomer and/or one anionic monomer, and at least one monomer of formula (I):

(I)

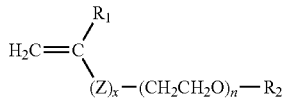

in which:
$R_1$ is an atom of hydrogen or a methyl radical;
x=0 or 1;
Z is a divalent grouping —C(=O)—O—, —C(=O)—NH—, or —$CH_2$—;
n is an integer between 1 and 250;
$R_2$ is a hydrogen atom or a carbonated radical—saturated or unsaturated, possibly aromatic, linear, ramified or cyclic—including from 1 to 30 carbon atoms and from 0 to 4 hetero-atoms chosen from the group including O, N and S.

12 Claims, No Drawings

SIZING COMPOSITION AND PROCESS FOR TEXTILE MATERIALS

CROSS REFERENCE TO RELATED APPLICATIONS

This application is a national stage filing under section 371 of International Application No. PCT/EP2013/073921, filed on Nov. 15, 2013, and published on May 30, 2014 as WO 2014/079776, which claims priority to French Application No. 1261042, filed on Nov. 20, 2012. The entire contents of each of said applications are hereby incorporated herein by reference.

The invention herein concerns the domain of treatment of textile materials, particularly the operations of sizing these materials prior to their weaving. The invention concerns the use of a sizing composition for textile materials including at least one specific water-soluble co-polymer.

By "textile materials", one should understand textile yarns, filaments and fibers, both natural and/or synthetic. The invention particularly concerns the sizing of natural fibers, notably of cotton type, with the possible presence of artificial fibers particularly polyester. According to the invention, textile materials do not include any mineral materials such as glass fibers.

In the textiles industry, during weaving operations, yarns or fibers are subjected to repeated extension stress, which can cause breakages. Therefore, one has to act on the yarn's extension capability, which depends on its nature.

In addition to the extension phenomenon, there are other constraints, notably:

- abrasion, i.e. wear through friction, which gives rise to hairiness of yarns and the formation of pills. The wear generally results from friction on various parts (blades, comb teeth, etc.);
- fuzz, i.e. the tendency of ends of fibers to separate from the body of the spun yarn. This phenomenon gives rise to bonding between yarns, which causes yarn breakages or defects of insertion via the warp vector.

In order to protect yarns against these sources of damage, and to improve their resistance, previous art employs sizing products.

To obtain good results, the sizing agent is chosen to take account of the following characteristics:

- the yarn's strength and ultimate elongation;
- flexibility of the film of sizing agent, which has to follow the extensions undergone by the yarn;
- good adhesion to the yarn;
- suitable viscosity in relation to the yarn. An excessively high viscosity can cause difficulties in the event of a stoppage on the sizing machine.

In addition, the sizing must not damage the yarn, and the sizing bath must only be composed of compatible products. Moreover, it must not produce sizing agent deposits on the comb that, after hardening, could act as abrasives on the yarns.

It should be noted that the sizing is an intermediate primer that is eliminated after the weaving operation. This is an operation prior to the finishing of the fabric, at the end of which the sizing is completely eliminated. Therefore, it is advantageous to have a product that has a good solubility for the desizing, notably in water.

Furthermore, this desizing operation can be highly polluting through the resulting aqueous emissions; thus, it is essential to minimize the ingredients in the composition of the sizing that have a strong biological oxygen demand (BOD) or a strong chemical oxygen demand (COD), such as polyvinyl alcohol or starch.

The choice of the sizing depends on the nature of the weft, as well as the nature of the weaving, which can be:

- dry weaving (rapier looms, projectile looms, air jet looms, etc.);
- hydraulic weaving (water jet looms), which require products that are insensitive to water in the weaving conditions.

The main types of base products that can be used as sizing agent are natural or synthetic polymers, which are classed as follows:

- amylaceous products: starches (from seeds, or from tubers and roots), etc.;
- starch derivatives: ethers, acetates, etc.;
- cellulose derivatives: carboxymethyl, methyl and ethyl cellulose; polyvinyl alcohols and vinyl acetate copolymers polyesters;
- acrylics: these are suitable above all for synthetic and artificial yarns; however, they are also used in combination with amylaceous or cellulose-based products for natural fibers and mixtures thereof.

For instance, document EP 0 945 543 relates to a sizing composition comprising a grafted polymer. This polymer is obtained by grafting, after polymerization, a main polymer (styrene maleic anhydride polymer) with a molecule such as ethoxy polyethylene glycol. The amount of grafted compound (pending groups) depends on the amount that is added, and on the amount of reactive monomers of the main polymer.

Document US 2004/0166313 relates to a sizing composition specifically dedicated for glass fibers, comprising a copolymer of vinyl acetate. Adhesion on mineral materials such as glass fibers requires a specific chemistry such as that afforded by vinyl acetate polymers.

Document FR 2 842 814 relates to low molecular weight polymers (1000-60 000 g/mol) and their use as dispersion aid or grinding aid of mineral fillers.

Furthermore, patent FR 2 879 630, in the applicant's name, proposes acrylamide-based polymers with a molecular weight greater than 1 million g/mol as a sizing agent. These polymers enable one to obtain performances similar to previously-existing compositions notably based on PVA and starch, but with significantly lower quantities of sizing agent. They may contain a branching agent such as ethylene glycol di-acrylate which comprises two carbon carbon double bonds.

However, in reality, these polymers have the following two main disadvantages:

- they endow a stringy and tacky characteristic in the sizing agent tank;
- they have a tendency to accumulate on the drying rollers.

In addition, these polymers do not improve (1) the performance of the weaving and (2) the productivity of the weaving looms, even if one increases the batching.

The performance of the weaving corresponds with the quality of the fabric obtained after weaving, which is often expressed as a percentage. A fabric in which the fibers or yarns are properly crossed and present no defects is a good-quality weave.

The productivity of the weaving loom corresponds with the speed of weaving—often expressed in meters of fabric per minute —or the quantity of fabric obtained in a given time, expressed in kilograms per minute.

Thus, the industry has a need to improve the weaving performances and/or productivity, and to resolve the above-stated problems.

In a totally surprising manner, the applicant has found that the use of specific water-soluble co-polymers in a sizing agent composition resolves the two above-stated previously-unresolved problems, and also significantly improves the weaving performance and/or productivity.

The present invention covers the use of an aqueous composition for the sizing of textile materials, said aqueous composition includes at least one co-polymer obtained by the polymerization of at least one non-ionic monomer and/or one anionic monomer, and at least one monomer including at least one —($CH_2$—$CH_2$—O)-(ethylene-glycol) pattern.

As already stated, by textile materials one should understand yarns, filaments, textile fibers, and weaved or non-weaved fabrics. These textile materials are natural and/or artificial (synthetic).

According to a first characteristic of the invention, the aqueous composition for textile material sizing includes a co-polymer obtained by the free radical polymerization of at least one non-ionic monomer and/or one anionic monomer, and at least one formula (I) monomer;

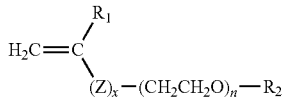

(I)

in which:

$R_1$ is an atom of hydrogen or a methyl radical;

x=0 or 1;

Z is a divalent grouping —C(=O)—O—, —C(=O)—NH—, or —$CH_2$—;

n is an integer between 1 and 250;

$R_2$ is a hydrogen atom or a carbonated radical—saturated or unsaturated, possibly aromatic, linear, ramified or cyclic—including from 1 to 30 carbon atoms and from 0 to 4 hetero-atoms chosen from the group including O, N and S.

More particularly, the formula (I) monomer can be chosen advantageously from the group including:

poly(ethylene-glycol) (meth)acrylate in which $R_1$=H or $CH_3$; Z=C(=O)—O; $R_2$=H; n=2 to 250;

methyl-poly(ethylene-glycol) (meth)acrylate, also called methoxy-poly(ethylene-glycol) (meth)acrylate, in which $R_1$=H or $CH_3$; Z=C(=O)—O; $R_2$=$CH_3$; n=2 to 250;

alkyl-poly(ethylene-glycol) (meth)acrylate in which $R_1$=H or $CH_3$; Z=C(=O)—O; $R_2$=alkyl in $C_1$-$C_{30}$; n=2 to 250;

phenyl-poly(ethylene-glycol) (meth)acrylates, also called poly(ethylene glycol) phenyl ether (meth)acrylate, in which $R_1$=H or $CH_3$; Z=C(=O)—O; $R_2$=phenyl; n=2 to 250.

Preferably, the monomer including an ethylene-glycol pattern will be between 0.5 and 50% in weight of the total weight of the co-polymer, and preferably between 1 and 25% in weight.

Preferably, the formula (I) monomer will be chosen from the group including poly(ethylene-glycol) (meth)acrylates and methyl-poly(ethylene-glycol) (meth)acrylates.

Furthermore, according to an advantageous implementation method, the composition used within the scope of the invention will include at least one co-polymer including, in weight in relation to the total weight of the co-polymer (for 100% of monomers):

from 10 to 99.5% of at least one non-ionic monomer;

from 0 to 80% of at least one anionic monomer;

from 0.5 to 50% of formula (I) monomer, preferably from 1 to 25%.

The non-ionic monomers can be chosen advantageously from the group including acrylamide and methacrylamide, N-isopropylacrylamide, N,N-dimethylacrylamide, N-methylolacrylamide, N-vinylformamide, N-vinyl acetamide, N-vinylpyridine, N-vinylpyrrolidone, acryloyl morpholine (ACMO), and acrylamide diacetone.

The anionic monomers can be chosen advantageously from the group including monomers having a carboxylic function (acrylic acid, methacrylic acid, and their salts), monomers with a sulfonic acid function (2-acrylamido-2-methylpropane sulfonic acid (ATBS) and its salts, . . . ).

By "salt", one generally understands alkaline salts, alkaline earth salts or ammonium salts.

According to another advantageous implementation method, the composition used within the scope of the invention will include at least one co-polymer including, in weight in relation to the total weight of the co-polymer (for 100% of monomers):

from 40 to 99% of acrylamide;

from 0 to 40% of acrylic acid in acid and/or salified form;

from 1 to 25% of formula (I) monomer.

Even if the sizing composition used within the scope of the invention can contain only water and the co-polymer described above, it can also contain other ingredients such as, for example, acrylamide-based polymers other than those employed in the invention, starches, starch derivatives, cellulose derivatives such as carboxymethyl cellulose, polyvinyl alcohols, vinyl acetate co-polymers, polyesters, and polyacrylates in latex form.

According to the invention, the sizing agent composition can contain several co-polymers.

Generally, the co-polymers contained in the composition do not require any particular polymerization process development. This is because they can be obtained by all the polymerization techniques well known to a knowledgeable professional, i.e. by polymerization in solution, polymerization in suspension, polymerization in bulk, polymerization by precipitation, polymerization in emulsion (aqueous or otherwise), possibly followed by a stage of spray drying, polymerization in suspension, micellar polymerization, possibly followed by a stage of precipitation, post-hydrolysis or co-hydrolysis polymerization, so-called "template" polymerization, radical polymerization, or controlled radical polymerization.

The co-polymer can be in liquid or solid form when its preparation includes a stage of drying, such as spray drying, drum drying or microwave drying.

The co-polymer will preferably be obtained by polymerization in solution or in bulk.

The co-polymer can also be connected by at least one ramification agent, which can be chosen from the group including polyethylenic unsaturation monomers (having at least two unsaturated functions) such as, for example, vinyl, allylic, acrylic and epoxy functions, and one can cite as an example methylene bis acrylamide (MBA), triallyamine, or macro-primers such as polyperoxides, polyazoics and transfer polyagents such as polymer-capturing polymers.

Transfer agents allowing one to limit the length of polymer chains can also be used for the polymerization of the co-polymer. Hereafter is a non-exhaustive list of transfer agents: isopropyl alcohol, sodium hypophosphite, mercaptoethanol.

According to a preferred embodiment, the molecular weight of the co-polymer is greater than 100.000 g/mol. It preferably ranges from 200.000 g/mol to 5 million g/mol, and more preferably from 500.000 to 2 million g/mol.

The composition advantageously can contain between 0.1 and 10%, in weight, of the co-polymer preferably between 0.5 and 5%. The water-soluble co-polymer is easily employed in water or in a aqueous solution, at the concentration desired by the user.

Typically, the composition does not comprise any mineral filler.

The invention herein also covers a process of sizing textile materials including a sizing stage consisting in:

- preparing an aqueous sizing composition including at least one co-polymer obtained by the polymerization of at least one non-ionic monomer and/or one anionic monomer, and at least one monomer containing at least one —($CH_2$—$CH_2$—O)—pattern;
- optionally, heating the said composition;
- sizing the textile materials, advantageously by immersion in the said aqueous composition.

The invention herein also covers a process of production of a textile including the following stages:

- preparing an aqueous sizing composition including at least one co-polymer obtained by the polymerization of at least one non-ionic monomer and/or one anionic monomer, and at least one monomer containing at least one —($CH_2$—$CH_2$—O)—pattern;
- optionally, heating the said composition;
- sizing the textile materials, advantageously by immersion in the said aqueous composition.
- weaving the sized textile materials.

This process can also include a stage of desizing the textile at the end of the weaving stage, consisting in removing by means of an aqueous solution the sizing composition (sizing agent) previously deposited on the surface of the textile materials, The sizing composition can advantageously be heated before use for instance, to 110° C. for 20 minutes, or to 90° C. for 30 minutes. In practice, for the man skilled in the art, this will be a baking stage.

The sizing process may include an additional stage, after the weaving, of desizing the previously-sized textile material, by removing the sizing agent deposited on the surface of the materials by means of an aqueous solution.

After the desizing stage, the process generally includes a drying stage.

The sizing stage is performed using facilities known to the art, without this constituting a limitation of the invention.

The composition described above enables one to conserve an effective and particularly-easy desizing stage. This is because the use of simple hot water is sufficient, whereas conventional compositions based on starch and polyvinyl alcohols require more-complex desizing solutions containing solvents, and are therefore harmful to the environment.

By "textile fiber sizing", one should also understand belt adhesives employed in fabric printing processes. More precisely, the belt carrying the fabric is coated by dipping in the composition. The effect sought is the temporary adhesion of the fabric to the belt, so that the fabric does not move during the finishing operations. The advantage accrued is a reduction of the batchings of active materials in the belt adhesive compositions.

The use of sizing compositions in accordance with the invention resolves the problems with acrylamide-based polymers described in patent FR 2 879 630, such as stringiness in the bath and clogging of the drying rollers.

In addition, one of the advantages of the compositions is that one can exceed the performances obtained with the best existing compositions. This enhancement is results in an increase in the quality of the weave, which enables one to obtain more fabric of better quality, with resulting added value in the textile material. It also provides an improvement in the productivity of the weaving loom, i.e. the ability to produce more quantity while conserving the same quality.

The invention and the resulting advantages will come to the fore clearly in the following implementation examples.

EXAMPLES

A) Data Pertaining to Polymers Used During Tests as Sizing Agent

| Sizing agent | Type | Composition (% of weight) |
|---|---|---|
| INV-1 | Powder obtained by polym. in bulk | AM/MPEG MA 92/8 |
| INV-2 | Powder obtained by polym. in bulk | AM/AA/MPEG MA 69/23/8 |
| CE-3 | Powder obtained by polym. in bulk | AM 100% |

AM: acrylamide
AA: acrylic acid
MPEG MA: methyl-poly(ethylene glycol) methacrylate, n = 45
INV-1 and INV-2 are two polymers according to the invention.
CE-3 is polymer P1 according to patent FR 2 879 630.

B) Data Pertaining to the Sizing Tests

Example 1

100% Combed Cotton Ne 40

Preparation of the sizing bath (800 L): You add the ingredient(s) of the sizing composition in a tank under agitation. You then transfer the resulting composition into a cooker, before baking for 20 minutes at 110° C. The composition is then ready to constitute a sizing bath.

Execution of the tests: you immerse 8,200 yarns of combed cotton Ne(c)=40 (English cotton number), separated into two layers, in two sizing baths containing the aforesaid preparation, which you press by passing them between two squeezing cylinders, so as to obtain a wet output of 110% in weight (sizing weight corresponding to 1.1 times the weight of the fabric). The yarns are then dried by successive passages over rollers heated to 120° C. The residual wetness of the yarns on exiting from drying is 5-7% in weight (measurement performed using a Mahlo online wetness meter), which constitutes a good drying.

Table 1 below states the conditions for the tests performed, together with the weaving results.

TABLE 1

| Tests | Description | Sizing: Polymer/% of weight of polymer in the bath (as dry material) | Sizing: Viscosity cup (Zahn 3) | Sizing: Speed of sizing machine | Weaving on Tsudakoma air jet loom: Weaving speed | Weaving on Tsudakoma air jet loom: Efficiency of the weaving loom |
|---|---|---|---|---|---|---|
| 1 | composition as per FR 2 879 630 | CE-3/1.3% | 20 secs. | 40 m/min. | 700 rpm | 89% |
| 2 | Conventional composition | CMS/9%<br>CMC/0.5%<br>PVA 1788/1% | 20 secs. | 40 m/min. | 700 rpm | 91% |
| 3 | Composition according to the invention | INV-1/2.6% | 20 secs. | 40 m/min. | 700 rpm | 96% |
| 4 | Composition according to the invention | INV-1/2.6% | 20 secs. | 40 m/min. | 850 rpm | 93% |

CMS (Carboxymethyl Starch): Modified starch
CMC (Carboxymethyl Cellulose): Modified cellulose
PVA 1788: Polyvinyl alcohol
The viscosity of the sizing composition is measured via a flow cup of Zahn 3 type.

Results:

The use of the composition according to the invention enables one to very significantly improve the quality of weaving with yarns of combed cotton Ne(c)=40, at the same weaving speeds (test 3). This is because the increase in efficiency of the weaving loom from 90 to 96% is derived from a decrease in the number of defects in the weaved fabric and, consequently, added value in the textile material.

The use of the composition according to the invention also allows one (test 4) to increase the productivity of the weaving loom by means of an increase in the weaving speed of 21% (700 to 850 rpm), while also improving the quality of the fabric in comparison with known compositions (89-91% to 93%).

Polymer CE-3 cannot be used at a batching exceeding 1.3% in the sizing bath, because you obtain an excessively-high viscosity and the very-stringy rheology obtained under these conditions does not allow one, strictly speaking, to complete the sizing stage.

It was observed that the use of the composition according to the invention gives one sized yarns having a very slippery appearance (smooth to the touch), whereas the known compositions (tests 1 and 2) give yarns that are less slippery (rougher to the touch).

Example 2

Spun Rayon Viscose Ne 30

Preparation of the sizing bath (800 L): You add the ingredient(s) of the sizing composition in a tank under agitation. You then transfer the resulting composition into a cooker, before baking for 20 minutes at 110° C. The composition is then ready to constitute a sizing bath.

Execution of the tests: you immerse 4,080 yarns of spun rayon viscose Ne(c)=30 (English cotton number) in a sizing bath containing the aforesaid preparation, which you press by passing them between two squeezing cylinders, so as to obtain a wet output of 120% in weight. The yarns are then dried by successive passage over rollers heated to 120° C. The residual wetness of the yarns on exiting from drying is 10-12% in weight (measurement performed using a Mahlo online wetness meter), which constitutes a good drying.

Table 2 below states the conditions for the tests performed, together with the weaving results.

TABLE 2

| Test | Description | Sizing: Polymer/% of polymer in the bath (as dry material) | Sizing: Viscosity cup (Zahn 3) | Sizing: Speed of sizing machine | Weaving on Tsudakoma air jet loom: Weaving speed | Weaving on Tsudakoma air jet loom: Efficiency of the weaving loom |
|---|---|---|---|---|---|---|
| 5 | composition as per FR 2 879 630 | CE-3/1.1% | 12 secs. | 45 m/min. | 700 rpm | 85% |
| 6 | Conventional composition | Starch/3.1%<br>CMS/1.3%<br>Urea/0.3%<br>PVA 1788/1% | 12 secs. | 45 m/min. | 700 rpm | 86% |
| 7 | Composition according to the invention | INV-2/1.3% | 13 secs. | 45 m/min. | 700 rpm | 96% |

TABLE 2-continued

| Test | Description | Sizing | | | Weaving on Tsudakoma air jet loom | |
|---|---|---|---|---|---|---|
| | | Polymer/% of polymer in the bath (as dry material) | Viscosity cup (Zahn 3) | Speed of sizing machine | Weaving speed | Efficiency of the weaving loom |
| 8 | Composition according to the invention | INV-2/1.3% | 13 secs. | 45 m/min. | 800 rpm | 94% |

Results:

The use of the composition according to the invention enables one to very significantly improve the quality of weaving with yarns of spun rayon viscose Ne(c)=30, at the same weaving speeds (test 7). The increase in efficiency of the weaving loom from 86 to 96% results from a decrease in the number of defects in the weaved fabric and, consequently, added value in the textile material.

The use of the composition according to the invention also allows one (test 8) to increase the productivity of the weaving loom by means of an increase in the weaving speed of 14% (700 to 850 rpm), while also improving the quality of the fabric in comparison with known compositions (85-86% to 94%).

It was observed that the use of the composition according to the invention gives one sized yarns having a very slippery appearance (smooth to the touch), whereas the known compositions (tests 5 and 6) give yarns that are less slippery (rougher to the touch).

Example 3

PES/Cotton 65/35

Preparation of the sizing bath (800 L): You add the ingredient(s) of the sizing composition in a tank under agitation. You then transfer the resulting composition into a cooker, before baking for 20 minutes at 110° C. The composition is then ready to constitute a sizing bath.

Execution of the tests: you immerse 5,074 yarns of PES/cotton (ration 65/35) Ne(c)=30 (English cotton number) in a sizing bath containing the aforesaid preparation, which you press by passing them between two squeezing cylinders, so as to obtain a wet output of 120% in weight. The yarns are then dried by successive passage over rollers heated to 120° C. The residual wetness of the yarns on exiting from drying is 5-7% in weight (measurement performed using a Mahlo online wetness meter), which constitutes a good drying.

Table 3 below states the conditions for the tests performed, together with the weaving results.

TABLE 3

| Recipe | Description | Sizing | | | Weaving on TOYOTA air jet loom | |
|---|---|---|---|---|---|---|
| | | Polymer/% of polymer in the bath (as dry material) | Viscosity cup (Zahn 3) | Speed of sizing machine | Weaving speed | Efficiency of the weaving loom |
| 9 | composition as per FR 2 879 630 | CE-3/1.1% | 12 secs. | 40 m/min. | 650 rpm | 82% |
| 10 | Conventional composition | CMS/8.3% CMC/2.0% PVA 1788/ 2.5% | 12 secs. | 40 m/min. | 650 rpm | 85% |
| 11 | Composition according to the invention | INV-2/1.3% | 13 secs. | 40 m/min. | 650 rpm | 94% |
| 12 | Composition according to the invention | INV-2/1.3% | 13 secs. | 40 m/min. | 750 rpm | 90% |

Results:

The use of the composition according to the invention enables one to very significantly improve the quality of weaving with yarns of spun rayon viscose Ne(c)=30, at the same weaving speeds (test 11). The increase in efficiency of the weaving loom from 85 to 94% results from a decrease in the number of defects in the weaved fabric and, consequently, added value in the textile material.

The use of the composition according to the invention also allows one (test 12) to increase the productivity of the weaving loom by means of an increase in the weaving speed of 15% (650 to 850 rpm), while also improving the quality of the fabric in comparison with known compositions (82-85% to 90%).

It was observed that the use of the composition according to the invention gives one sized yarns having a very slippery appearance (smooth to the touch), whereas the known compositions (tests 9 and 10) give yarns that are less slippery (rougher to the touch).

The invention claimed is:

1. A process for manufacturing a textile, the process comprising the following stages:

preparing an aqueous sizing composition including at least one co-polymer obtained by the polymerization of at least one non-ionic monomer and/or one anionic monomer, and at least one monomer of formula (I),

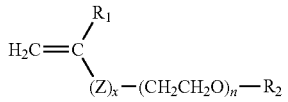

(I)

in which:

$R_1$ is hydrogen or a methyl group;

x =0 or 1;

Z is a divalent grouping —C(=O)—O—, —C(=O)—NH—, or —$CH_2$—;

n is an integer between 1 and 250; and $R_2$ is hydrogen, $C_1$-$C_{30}$alkyl, or phenyl, wherein the non-ionic monomer is selected from the group consisting of acrylamide, methacrylamide, N-isopropylacrylamide, N,N-dimethylacrylamide, N-methylolacrylamide, N-vinylformamide, N-vinyl acetamide, N-vinylpyridine, N-vinylpyrrolidone, acryloyl morpholine (ACMO), and acrylamide diacetone, and wherein the anionic monomer is selected from the group consisting of acrylic acid, methacrylic acid, and 2-acrylamido-2-methylpropane sulfonic acid, and their salts;

optionally, heating the said composition;

sizing a textile material with the aqueous sizing composition, thereby obtaining sized textile material;

weaving the sized textile material; and desizing the textile material at the end of the weaving stage, wherein said desizing comprises removing—by means of an aqueous solution—sizing composition previously deposited on a surface of the textile material.

2. A process according to claim 1, further comprising, after the sizing and weaving stages, a drying stage.

3. A process according to claim 1, wherein the textile material is a yarn, filament, textile fiber, or weaved or unweaved fabric; and the said textile material is natural and/or artificial.

4. A process according to claim 1, wherein the co-polymer is obtained by the polymerization of monomers consisting of:

one or more non-ionic monomers selected from the group consisting of acrylamide, methacrylamide, N-isopropylacrylamide, N,N-dimethylacrylamide, N-methylolacryl amide, N-vinylformamide, N-vinyl acetamide, N-vinylpyridine, N-vinylpyrrolidone, acryloyl morpholine (ACMO), and acrylamide diacetone;

one or more anionic monomers selected from the group consisting of acrylic acid, methacrylic acid, and 2-acrylamido-2-methylpropane sulfonic acid, and their salts; and one or more monomers of formula (I).

5. A process according to claim 1, wherein the co-polymer is obtained by polymerizing a monomer mixture, wherein all non-ionic monomers in the mixture are selected from compounds of formula (I) and the non-ionic monomers listed in claim 1, and wherein all anionic monomers in the mixture are selected from the anionic monomers listed in claim 1.

6. A process according to claim 1, wherein the formula (I) monomer represents between 0.5 and 50% in weight, in relation to the total weight of the co-polymer.

7. A process according to claim 1, wherein the formula (I) monomer is selected from the group consisting of poly (ethylene-glycol) (meth)acrylates and methyl-poly(ethylene-glycol) (meth)acrylates.

8. A process according to claim 1, wherein the co-polymer includes, in weight in relation to the total weight of the co-polymer:

from 10 to 99.5% of at least one non-ionic monomer;

from 0 to 80% of at least one anionic monomer; and from 0.5 to 50% of formula (I) monomer.

9. A process according to claim 8, wherein the co-polymer consists of, in weight in relation to the total weight of the co-polymer:

from 10 to 99.5% of at least one non-ionic monomer selected from the group consisting of acrylamide, methacrylamide, N-isopropylacrylamide, N,N-dimethylacrylamide, N-methylolacrylamide, N-vinylformamide, N-vinyl acetamide, N-vinylpyridine, N-vinylpyrrolidone, acryloyl morpholine (ACMO), and acrylamide diacetone;

from 0 to 80% of at least one anionic monomer selected from the group consisting of acrylic acid, methacrylic acid, and 2-acrylamido-2-methylpropane sulfonic acid, and their salts; and from 0.5 to 50% of at least one monomer of formula (I).

10. A process according to claim 1, wherein the co-polymer includes, in weight in relation to the total weight of the co-polymer:

from 40 to 99% of acrylamide;

from 0 to 40% of acrylic acid in acid and/or its salt; and from 1 to 25% of formula (I) monomer.

11. A process according to claim 1, wherein the co-polymer is obtained by polymerization in solution or in bulk.

12. A process according to claim 1, wherein the composition contains between 0.1 and 10% in weight of co-polymer.

* * * * *